US008611571B2

(12) United States Patent
Petrausch

(10) Patent No.: US 8,611,571 B2
(45) Date of Patent: Dec. 17, 2013

(54) BINAURAL HEARING APPARATUS AND METHOD FOR OPERATING A BINAURAL HEARING APPARATUS WITH FREQUENCY DISTORTION

(75) Inventor: Stefan Petrausch, Erlangen (DE)

(73) Assignee: Siemens Medical Instruments Pte. Ltd., Singapore (SG)

( * ) Notice: Subject to any disclaimer, the term of this patent is extended or adjusted under 35 U.S.C. 154(b) by 809 days.

(21) Appl. No.: 12/779,981

(22) Filed: May 14, 2010

(65) Prior Publication Data

US 2010/0290631 A1 Nov. 18, 2010

(30) Foreign Application Priority Data

May 14, 2009 (DE) ..... 10 2009 021 310

(51) Int. Cl.
*H04R 25/00* (2006.01)

(52) U.S. Cl.
USPC ..... 381/316; 381/320; 381/312

(58) Field of Classification Search
USPC ..... 381/312, 313, 316, 320, 71.11, 71.12, 381/94.1
See application file for complete search history.

(56) References Cited

U.S. PATENT DOCUMENTS

| | | | | |
|---|---|---|---|---|
| 6,831,986 | B2 | 12/2004 | Kates | |
| 7,580,536 | B2 | 8/2009 | Carlile et al. | |
| 7,769,439 | B2 | 8/2010 | Vesely et al. | |
| 8,180,081 | B2 | 5/2012 | Lunner | |
| 2004/0175010 | A1* | 9/2004 | Allegro et al. | 381/312 |
| 2009/0041272 | A1* | 2/2009 | Puder et al. | 381/318 |
| 2009/0074197 | A1 | 3/2009 | Neher et al. | |

FOREIGN PATENT DOCUMENTS

| | | | |
|---|---|---|---|
| DE | 69922940 | T2 | 12/2005 |
| EP | 1333700 | A2 | 8/2003 |
| EP | 1742509 | A1 | 1/2007 |
| WO | 2005015952 | A1 | 2/2005 |
| WO | 2006101571 | A2 | 9/2006 |

OTHER PUBLICATIONS

Joson et al., "Adaptive feedback cancellation with frequency compression for hearing aids", Acoustical Society of America, 94 (6), Dec. 1993, pp. 3248-3254.

* cited by examiner

*Primary Examiner* — Brian Ensey
(74) *Attorney, Agent, or Firm* — Laurence A. Greenberg; Werner H. Stemer; Ralph E. Locher

(57) ABSTRACT

A binaural hearing apparatus has at least one left hearing device and at least one right hearing device. The apparatus further includes a first frequency distortion unit in the left hearing device, which distorts the frequency of an acoustic signal received by the left hearing device or a signal part of the received acoustic signal and a second frequency distortion unit in the right hearing device, which distorts the frequency of the acoustic signal received by the right hearing device or a signal part of the received acoustic signal, with the frequency distortions of the left and right hearing device being different. This is advantageous in that the subjective perception of superimposition artifacts by a hearing device wearer is reduced.

15 Claims, 5 Drawing Sheets

BINAURAL HEARING APPARATUS AND METHOD FOR OPERATING A BINAURAL HEARING APPARATUS WITH FREQUENCY DISTORTION

CROSS-REFERENCE TO RELATED APPLICATION

This application claims the priority, under 35 U.S.C. §119, of German application DE 10 2009 021 310.4, filed May 14, 2009; the prior application is herewith incorporated by reference in its entirety.

BACKGROUND OF THE INVENTION

1. Field of the Invention

The invention relates to a method for operating a binaural hearing apparatus with frequency distortion and a binaural hearing apparatus with frequency distortion.

In hearing apparatuses, in particular in hearing devices, frequency-distorting algorithms are used for different purposes and at different points in a signal processing. German utility model DE 699 22 940 T2 discloses a hearing device with a combination of audio compression and feedback suppression for instance.

The frequency-distorting algorithms unfortunately also produce clearly perceivable artifacts. A distortion at low frequencies is generally not possible since the human ear reacts very sensitively in the low frequency range. Only the high frequencies are therefore distorted. Nevertheless, this may result in an audible "detuning" of a useful signal.

Superimposition artifacts are considerably more unpleasant, in which the distorted signal and the undistorted signal are perceived at the same time, thereby resulting, in the case of tonal signals, in a clear modulation and/or beat frequency or a roughness. Acoustic superimpositions, which take place as a result of the inflow of direct sound through the vent for instance, are almost completely unavoidable. Superimpositions as a result of non-ideal split-band filters may also result however as a result of the design type. To be able to only distort high frequency parts, these must be separated from the low frequency parts. To this end, a split-band filter is needed. The split-band filter can however not carry out an ideal separation, as a result of which interfering superimpositions result in the region of the cut-off frequency.

As a function of the frequency distortion, these superimpositions are perceived as amplitude modulation or as signal roughness. In all described cases, the superimpositions are interfering, particularly if an input signal is music or more generally tonal signals.

FIG. 1 shows a block diagram of an exemplary realization of a frequency distortion in a hearing device. An input signal 100 is divided by a split band filter 1 with a predeterminable cut-off frequency GF (split frequency) into a low frequency and a high frequency signal part 101, 102. The high frequency signal part 102 is then distorted in a frequency distorter 2. The distorted output signal 103 is fed to an input of an adder 3. The low frequency signal part 101 passes through an all-pass filter 4, which rotates the phase of the signal part 101 such that in the case of a subsequent signal addition in the adder 3, signal deletions do not result in the region of the cut-off frequency GF. The phase-rotated low frequency signal part 104 is fed to a further input of the adder 3. The total of the two signal parts 103, 104 is available as an output signal 105 at the output of the adder 3.

Split-band filters are not ideal and have an endless frequency overlapping in the case of their cut-off frequency GF.

FIG. 2 shows an example of the frequency response of a split-band filter in a hearing device with the cut-off frequency GF of 1800 Hz. The curves K1, K2 indicate the attenuation D in dB as a function of the frequency F in Hz in the range between 0 to 4000 Hz. The curve K1 shows a low-pass characteristic and the curve K2 shows a high-pass characteristic.

If a low-pass K1 filtered signal part is now not distorted and a high pass K2 filtered signal part is distorted, when the signal parts K1, K2 are added, this results above all in the region of the cut-off frequency GF in a not insignificant superimposition of both signal parts, which, in an output signal of the hearing device, is perceived as modulation or significant roughness. Both effects are very interfering and, in terms of the perception of a hearing device wearer, are in most cases significantly more obvious than the frequency distortion itself.

Strong frequency-distorting algorithms are generally used in the case of significant hearing losses, with artifacts being accepted and/or not perceived by hearing-impaired persons. Problems nevertheless also cause weak frequency-distorting algorithms, which are used for instance to assist with feedback suppression. Since these are to be useable for all hearing device wearers, they must be as inconspicuous as possible. An on/off logic is therefore currently used above all, which activates the frequency distortion when feedback artifacts are surmised and which switches off the frequency distortion when no feedback is surmised. This logic is in this case certainly disadvantageous in that a feedback whistling first has to be detected before the algorithm is switched on, which then in turn requires a certain amount of time until it achieves its full effect. This delays the feedback suppression and runs the risk of fault recognition.

Published, European patent application EP 1 333 700 A2 discloses a method and a hearing device for frequency shift purposes. A shifted spectrum is obtained here from the spectrum of a microphone signal of the hearing device by a nonlinear frequency shift function.

SUMMARY OF THE INVENTION

It is accordingly an object of the invention to provide a binaural hearing apparatus and a method for operating a binaural hearing apparatus with frequency distortion which overcome the above-mentioned disadvantages of the prior art methods and devices of this general type, which reduces the perception of artifacts when using frequency-distorting algorithms in a binaural hearing device supply.

The invention recites a method for operating a binaural hearing apparatus with at least a left hearing device and with at least a right hearing device. The method includes the steps of: distorting the frequencies of an acoustic signal received by the left hearing device or a signal part of the received acoustic signal; and distorting the frequencies of the acoustic signal received by the right hearing device or a signal part of the received acoustic signal, with the frequency distortions of the left and right hearing device being different. The subjective perception of superimposition artifacts by a hearing device wearer is herewith reduced.

In one development of the invention, the acoustic signal received by the left hearing device or the signal part of the received acoustic signal and the acoustic signal received by the right hearing device or the signal part of the received acoustic signal are distorted antisymmetrically relative to one another. This is advantageous in that superimposition artifacts are more inconspicuous for a hearing device wearer as a result of a decentralized localization.

In a further embodiment, the acoustic signal received by the left hearing device or the signal part of the received acoustic signal and the acoustic signal received by the right hearing device or the signal part of the received acoustic signal are distorted asymmetrically relative to one another. This is advantageous in that a tonal detuning of an input signal is concealed for a hearing device wearer.

The frequency distortions of the left and right hearing device can advantageously include a frequency shift and/or a frequency compression.

Furthermore, the frequency distortions can be changed temporally. As a result, the superimposition artifacts vary, as a result of which they are less perceivable for a hearing device wearer and a sensed tonal tilt is avoided.

In a further embodiment, the frequency distortions of the left and right hearing device can be binaurally coupled to one another. As a result, synchronism is ensured.

In one development, the frequencies are distorted in one or several frequency sub-bands.

The invention also claims a binaural hearing apparatus with at least a left hearing device and at least a right hearing device. The hearing apparatus includes a first frequency distortion unit in the left hearing device, which distorts the frequencies of an acoustic signal received by the left hearing device or a signal part of the received acoustic signal and a second frequency distortion unit in the right hearing device, which distorts the frequencies of the acoustic signal received by the right hearing device or a signal part of the received acoustic signal, with the frequency distortions of the left and right hearing device being different.

In one development of the invention, the first and the second frequency distortion units can distort antisymmetrically relative to one another.

In a further embodiment, the first and the second frequency distortion units can distort asymmetrically relative to one another.

Furthermore, the frequency distortions of the first and second frequency distortion units can include a frequency shift and/or a frequency compression.

Furthermore, the frequency distortions of the first and second frequency distortion units can be changed temporally. In one development, the first and second frequency distortion units can be binaurally coupled to one another.

In a further embodiment, the frequencies can be distorted in one or several frequency sub-bands.

The hearing apparatus can advantageously include a first split-band filter in the left hearing device, which divides the received acoustic signal into a low frequency and a high frequency signal part, the frequencies of which are distorted and/or a second split-band filter in the right hearing device, which divides the received acoustic signal into a low frequency and a high frequency signal part, the frequencies of which are distorted.

Other features which are considered as characteristic for the invention are set forth in the appended claims.

Although the invention is illustrated and described herein as embodied in a binaural hearing apparatus and a method for operating a binaural hearing apparatus with frequency distortion, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
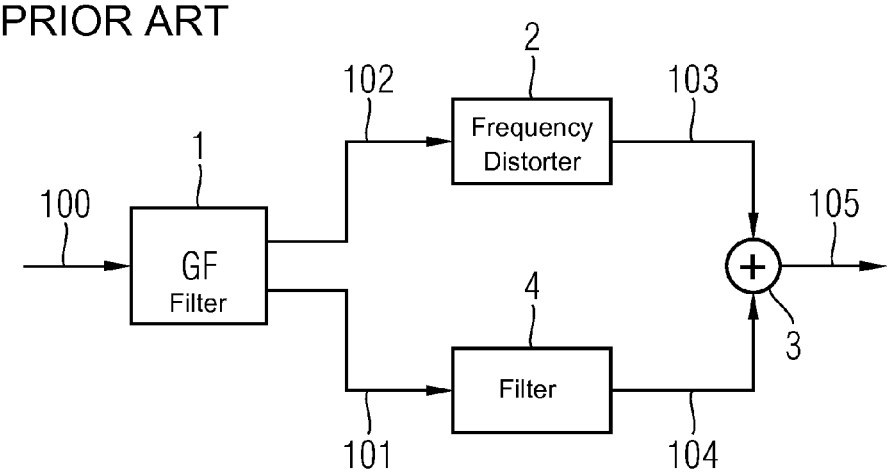
FIG. 1 PRIOR ART
FIG. 1 is a block diagram of an arrangement with a split-band filter according to the prior art.
Figure 2:
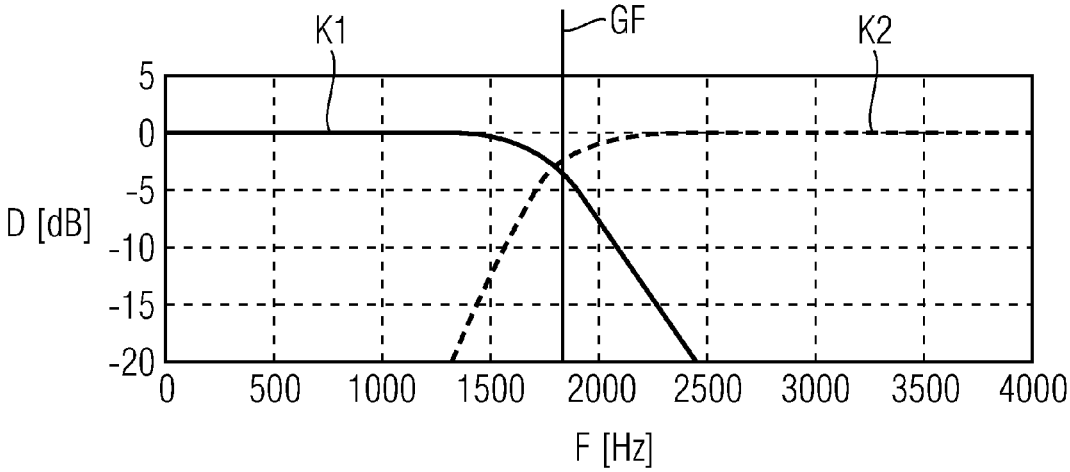
FIG. 2 PRIOR ART
FIG. 2 is a graph showing a frequency response of a split-band filter according to the prior art.
Figure 3:
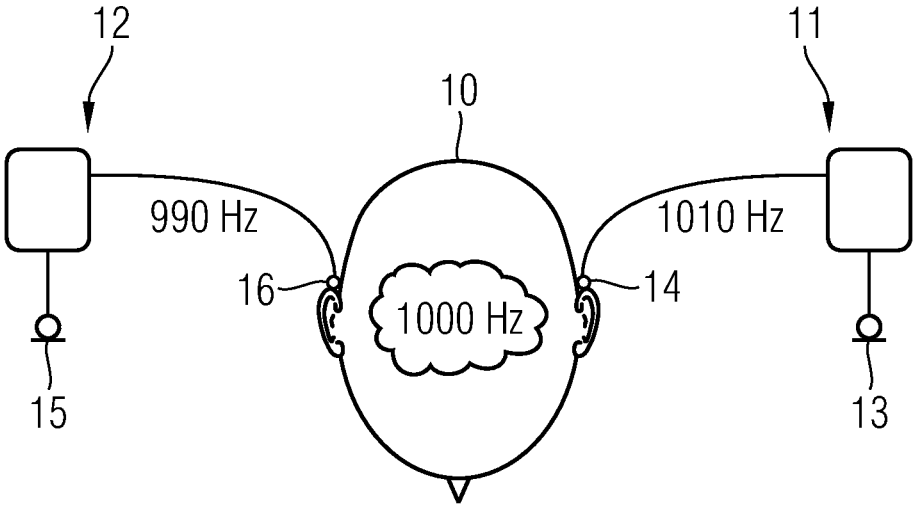
FIG. 3 is an illustration of a binaural hearing apparatus with antisymmetrical frequency distortion.
Figure 3:
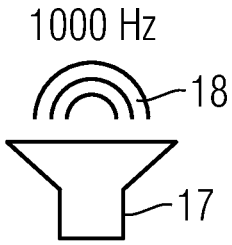

Referring now to the figures of the drawing in detail and first, particularly, to FIG. 3 thereof, there is shown by way of example the principle and mode of operation of the invention. The representation shows a head 10 of a hearing device wearer with a left hearing device 11 and a right hearing device 12 for a binaural supply. The left hearing device 11 includes a microphone 13 and a receiver 14. The right hearing device 12 includes a microphone 15 and a receiver 16. A sinusoidal sound signal 18 is emitted from a sound source 17 with frequency 1000 Hz. The sound signal 18 is received by the two microphones 13 and 15, converted into electrical signals in each instance, inter alia amplified and distorted in the frequency, before the signals are output by the receivers 14 and 16. The frequency distortion takes place anti-symmetrical with a 10 Hz frequency shift, i.e. the receiver signal of the left hearing device 11 amounts to 1010 Hz and the receiver signal of the right hearing device 12 amounts to 990 Hz. The hearing device wearer perceives the original 1000 Hz tone despite the frequency shift between the two shifts, in other words at the original frequency of 1000 Hz.

If a frequency distortion is adjusted anti-symmetrically in accordance with the invention, pure tones are originally perceived at a frequency between the two distortions, in other words at the original frequency. As a result, a tonal detuning of the sound signal 18 is concealed. A pure sinusoidal tone nevertheless appears wider to the hearing device wearer, but does not detune in respect of the original frequency. It is important here that a distortion and/or a shift is not too great, so that the brain of the hearing device wearer surmises the same original of the sound signal 18 for the right and left ear.

If a frequency distortion for the left and right ear is intentionally adjusted differently, this is not perceived so prominently as if the distortion was identical on both ears. The reasons for this effect are the interfering superimposition artifacts, which usually appear as signal modulation and are perceived very clearly in the case of tonal signals.

Figure 4:
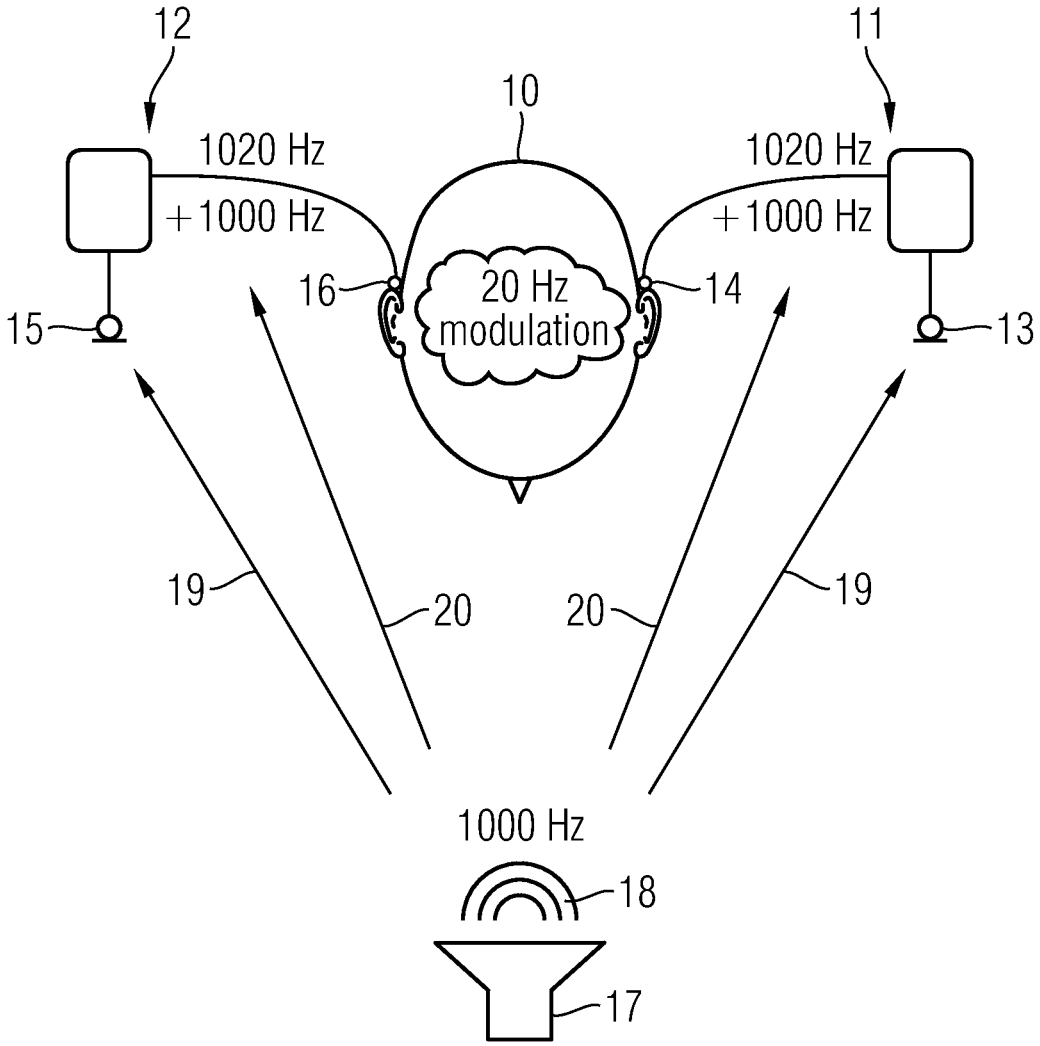
FIG. 4 is an illustration showing a binaural hearing apparatus with symmetrical frequency distortion.

FIG. 4 shows the effect of an identical phase shift for both ears of a hearing device wearer. FIG. 4 shows the head 10 of a hearing device wearer with the left hearing device 11 and the right hearing device 12 for a binaural supply. The left hearing device 11 includes the microphone 13 and the receiver 14. The right hearing device 12 includes the microphone 15 and the receiver 16. The sinusoidal sound signal 18 with a frequency of 1000 Hz is emitted from the sound source 17. The sound signal 18 is received on paths 19 by the two microphones 13 and 15, converted into electrical signals in each instance, inter alia amplified and shifted in terms of frequency by 20 Hz, before the signals are then output by the receivers 14 and 16. A hearing device user also perceives the sound signal 18 on direct paths 20, as so-called direct sound. By superimposing the direct sound of 1000 Hz and the sound emitted by the receivers 14 and 16 of 1020 Hz, a beat frequency with a frequency of 20 Hz is generated, which is perceived by the hearing device wearer to be central, directly in the actual head 10. As a result, the perception of an amplitude modulation determined by frequency distortion is amplified.

Figure 5:
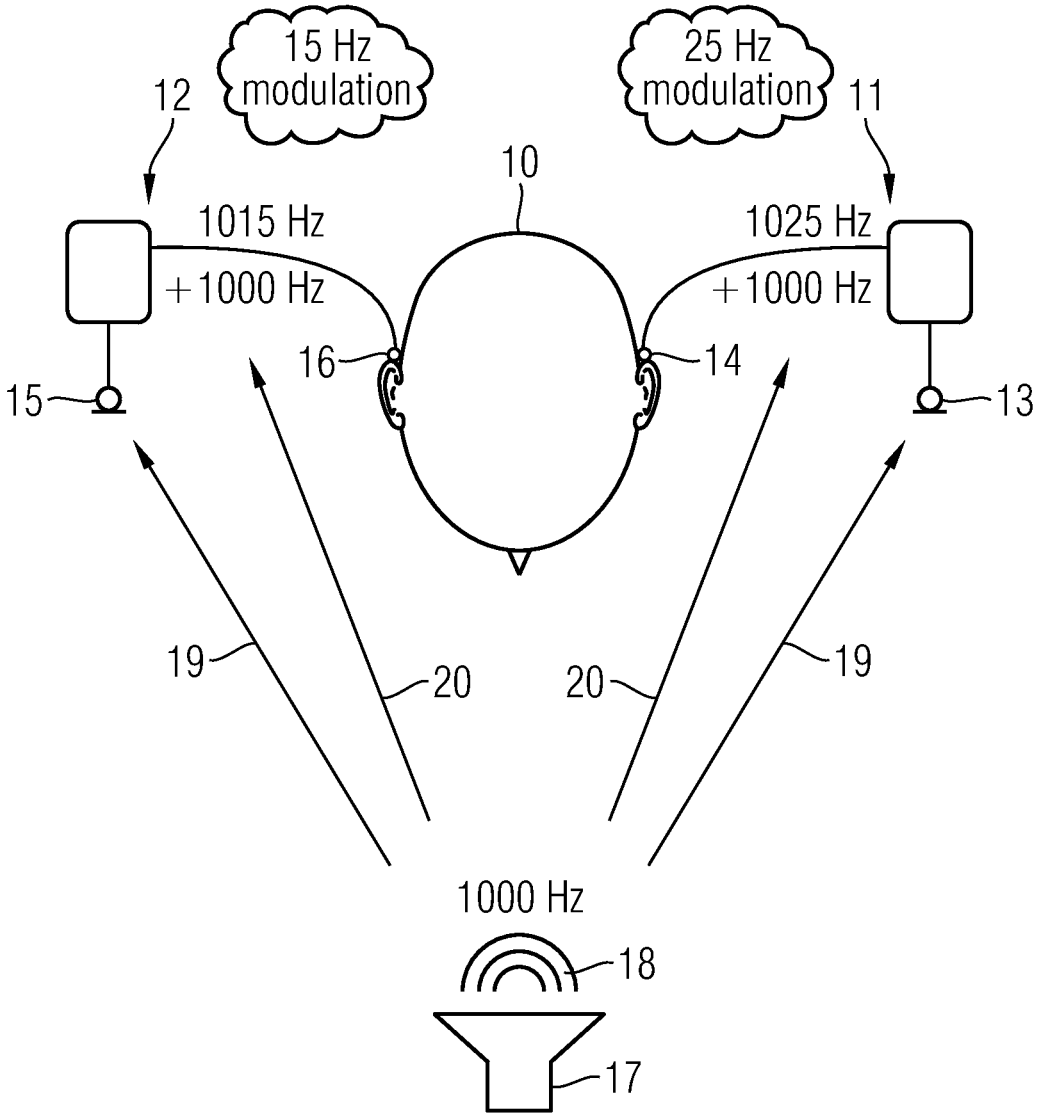
FIG. 5 is an illustration showing a binaural hearing apparatus with asymmetrical frequency distortion.

An inventive asymmetrical frequency distortion finds a remedy herefor, as shown in FIG. 5. FIG. 5 shows the head 10 of a hearing device wearer with the left hearing device 11 and the right hearing device 12 for a binaural supply. The left hearing device 11 includes the microphone 13 and the receiver 14. The right hearing device 12 includes the microphone 15 and the receiver 16. A sinusoidal sound signal 18 with a frequency of 1000 Hz is emitted from the sound source 17. The sound signal 18 is received on the paths 19 by the two microphones 13 and 15, converted into electrical signals in each instance, inter alia amplified and shifted in terms of frequency by 25 Hz and/or 15 Hz, before the signals are emitted by the receivers 14 and 16. A hearing device wearer also perceives the sound signal 18 on direct paths 20, as so-called direct sound. Superimposing the direct sound with 1000 Hz and the sound emitted by the receiver 14 of the left hearing device 11 with 1025 Hz produces a beat frequency with a frequency of 25 Hz, which is likewise perceived by the hearing device wearer outside the head 10, indicated by the cloud "25 Hz modulation". Superimposing the direct sound with 1000 Hz and the sound emitted by the receiver 16 of the right hearing device 12 with 1015 Hz produces a beat frequency with a frequency of 15 Hz, which is likewise perceived by the hearing device wearer outside the head 10, indicated by the cloud "15 Hz modulation".

If a different frequency distortion is therefore present on the right and left, a hearing device user localizes the source(s) of the beat frequency outside the head 10 and therefore assigns it/them to a background noise, since no correlation exists between the right and left ear. The adjustment of asymmetrical frequency distortions is thus a very simple method of minimizing artifacts of a frequency distortion.

In combination with the inventive solutions described with FIGS. 3 and 5, the frequency distortion and/or the intensity of the frequency distortion and/or frequency offset, can also be changed slowly and/or randomly over time. If the frequency distortion is used to assist with the feedback suppression for instance, there is usually a relatively large adjustment range for the frequency distortion. The degree of distortion can then be selected according to audiological points of view, generally such that superimposition artifacts are no longer perceived as pure modulation and/or beat frequency but instead as roughness and that the detuning is minimal.

A frequency offset can be varied and should also take place dynamically over time. On the one hand, it is therefore possible to prevent the same artifacts from consistently appearing with the same tones. If a hearing device wearer recognizes the critical tones after some wear time, he is only expecting them and it is irritating if he has to actually perceive the artifacts again. Furthermore, hearing tests have shown that with the inventive asymmetrical frequency distortion, a hearing device user can get a feel for a "tilt". If the tones in the left ear are always lower for instance than those in the right ear, the hearing device user can get the feeling that the hearing devices are positioned asymmetrically. This is prevented by the frequency distortion varying temporally and the right and left ear respectively being that with the higher frequency. If this takes place very slowly, the changes in the frequency distortion are not obvious to the hearing device wearer and there is no feeling of asymmetry. If the temporal variation does not follow any specific pattern, they are categorized by the brain as conventional fluctuations. It is also advantageous for the superimposition artifacts if the right ear and then sometimes the left ear has a higher modulation. Artifacts are tolerated more easily if they only take place now and then and without any identifiable pattern.

Figure 6:
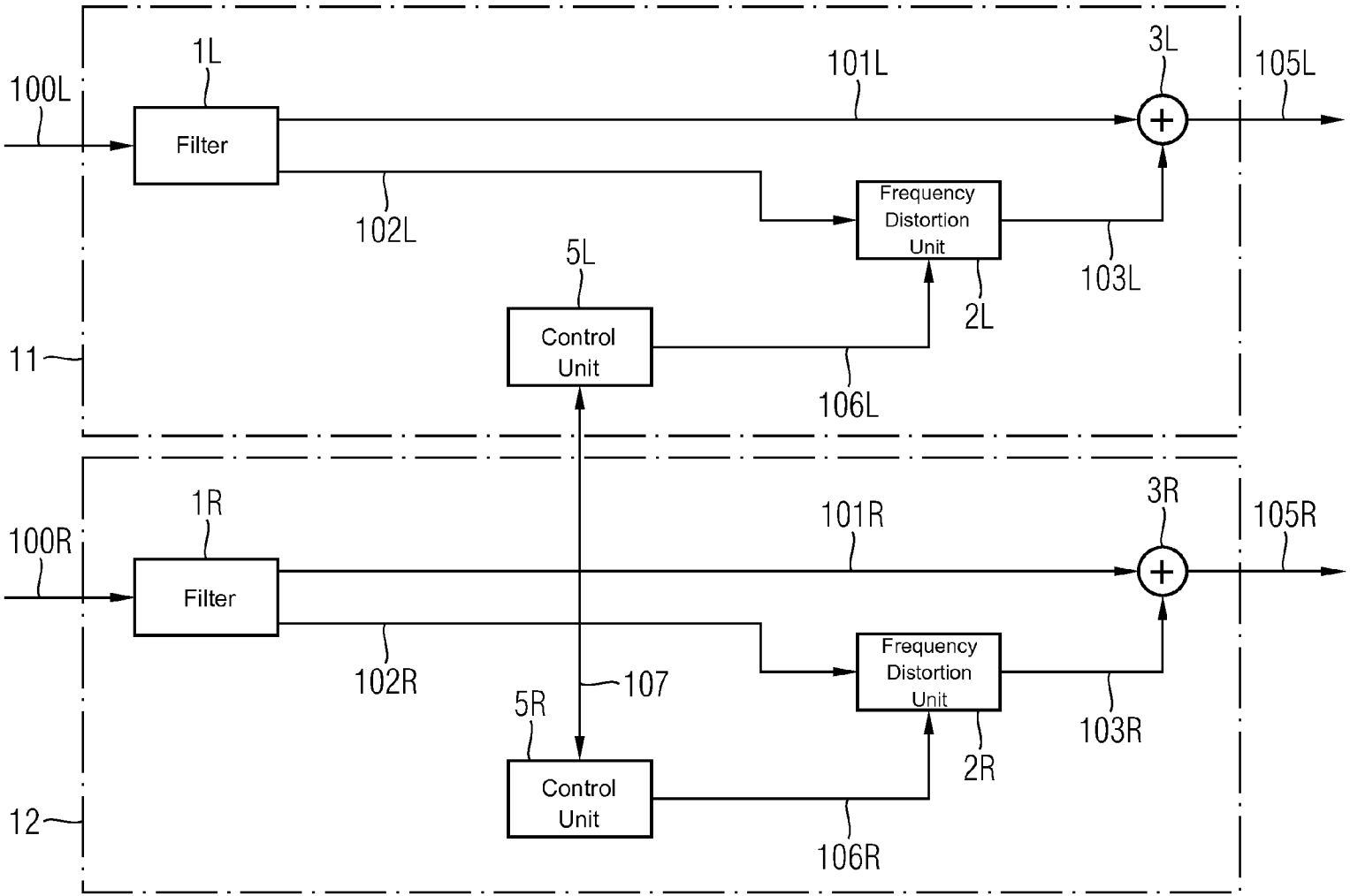
FIG. 6 is an illustration showing a block diagram of a binaural hearing apparatus.

FIG. 6 shows a block diagram of part of an inventive binaural hearing apparatus with a left and a right hearing device 11, 12. An input signal 100L of the left hearing device 11 is divided by a split-band filter 1L into a low frequency and a high frequency signal part 101L, 102L. The high frequency signal part 102L is then distorted in a first frequency distortion unit 2L. The distorted output signal 103L is fed to an input of an adder 3L. The low frequency signal part 101L is fed to a further input of the adder 3L. The total of the two signal parts 103L, 101L is available at the output of the adder 3L as an output signal 105L. By a frequency distortion control unit 5L of the left hearing device 11, the degree and/or intensity and the type of frequency distortion of the first frequency distortion unit 2L is controlled with the aid of a control signal 106L.

The same applies to the right hearing device 12. An input signal 100R of the right hearing device 12 is divided by a split-band filter 1R into a low frequency and a high frequency signal part 101R, 102R. The high frequency signal part 102R is then distorted in a second frequency distortion unit 2R. The distorted output signal 103R is fed to an input of an adder 3R. The low frequency signal part 101R is fed to a further input of the adder 3R. The total of the two signal parts 103R, 101R is available at the output of the adder 101R as output signal 105R. A frequency distortion control unit 5R of the right hearing device 12 controls the degree and/or the intensity and type of the frequency distortion of the second frequency distortion unit 2R with the aid of a control signal 106R.

The two frequency distortion control units 5L and 5R of the two hearing devices 11 and 12 are wirelessly coupled to one another and can be synchronized by way of a coupling signal 107, in order for example to remain strongly asymmetrical and/or strongly antisymmetrical in the frequency distortion despite temporal variation.

A temporal change can advantageously take place right and left, for instance equally as fast or with an identical empirical value. The change in the frequency distortion can takes place continually or in stages. It can be changed in a wideband manner, or however only in sub-bands.

The invention claimed is:

1. A method for operating a binaural hearing apparatus having at least a left hearing device and at least a right hearing device, which comprises the steps of:

distorting frequencies of one of a received acoustic signal received by the left hearing device and a signal part of the received acoustic signal; and distorting the frequencies of one of a received acoustic signal received by the right hearing device and a signal part of the received acoustic signal, with frequency distortions of the left and right hearing device being different.

2. The method according to claim 1, which further comprises distorting the received acoustic signal received by the left hearing device or the signal part of the received acoustic signal and the received acoustic signal received by the right hearing device or the signal part of the received acoustic signal antisymmetrically relative to one another.

3. The method according to claim 1, which further comprises distorting the received acoustic signal received by the left hearing device or the signal part of the received acoustic signal and the received acoustic signal received by the right hearing device or the signal part of the received acoustic signal asymmetrically relative to one another.

4. The method according to claim 1, wherein the frequency distortions of the left and right hearing device include at least one of a frequency shift and a frequency compression.

5. The method according to claim 1, which further comprises changing the frequency distortions temporally.

6. The method according to claim 1, which further comprising coupling binaurally to one another the frequency distortions of the left and right hearing device.

7. The method according to claim 1, which further comprises distorting the frequencies in at least one frequency sub-band.

8. A binaural hearing apparatus, comprising:

a left hearing device having a first frequency distortion unit for distorting frequencies of one of a received acoustic signal received by said left hearing device and a signal part of the received acoustic signal; and a right hearing device having a second frequency distortion unit for distorting frequencies of one of a received acoustic signal received by the right heading device and a signal part of the received acoustic signal, with frequencies distortions of said left and right hearing devices being different.

9. The hearing apparatus according to claim 8, wherein said first and the second frequency distortion units distort antisymmetrically relative to one another.

10. The hearing apparatus according to claim 8, wherein said first and the second frequency distortion units distort asymmetrically relative to one another.

11. The hearing apparatus according to claim 8, wherein the frequency distortions of said first and second frequency distortion units include at least one of a frequency shift and a frequency compression.

12. The hearing apparatus according to claim 8, wherein the frequency distortions can be changed temporally.

13. The hearing apparatus according to claim 8, wherein said first and second frequency distortion units can be binaurally coupled to one another.

14. The hearing apparatus according to claim 8, wherein the frequencies are distorted in at least one frequency sub-band.

15. The hearing apparatus according to claim 8, wherein:

said left hearing device has a first split-band filter which divides the received acoustic signal into a low frequency and a high frequency signal part, the frequency of which is distorted; and said right hearing device has a second split-band filter which divides the received acoustic signal into a low frequency and a high frequency signal part, the frequency of which is distorted.

* * * * *